US008100577B2

(12) United States Patent
Sardina, Jr.

(10) Patent No.: US 8,100,577 B2
(45) Date of Patent: Jan. 24, 2012

(54) FLUID BLENDING APPARATUS AND ASSOCIATED METHOD

(76) Inventor: Jose Elias Sardina, Jr., Lithia, FL (US)

( * ) Notice: Subject to any disclaimer, the term of this patent is extended or adjusted under 35 U.S.C. 154(b) by 506 days.

(21) Appl. No.: 12/360,198

(22) Filed: Jan. 27, 2009

(65) Prior Publication Data

US 2010/0188927 A1 Jul. 29, 2010

(51) Int. Cl.
*B01F 5/16* (2006.01)
*B01F 15/02* (2006.01)

(52) U.S. Cl. ..... 366/156.1; 366/162.2; 366/176.3; 366/181.3; 366/270

(58) Field of Classification Search ..... 366/156.1, 366/162.2, 168.2, 176.3, 181.3, 182.3, 262, 366/270

See application file for complete search history.

(56) References Cited

U.S. PATENT DOCUMENTS

| | | | | |
|---|---|---|---|---|
| 3,339,897 | A * | 9/1967 | Davis, Jr. | 366/265 |
| 4,159,880 | A * | 7/1979 | Herfeld | 366/266 |
| 4,194,843 | A * | 3/1980 | Martin | 366/138 |
| 4,439,042 | A * | 3/1984 | Bertoglio | 366/154.2 |
| 2005/0237853 | A1 * | 10/2005 | Martel et al. | 366/266 |

* cited by examiner

*Primary Examiner* — Robert B Davis
(74) *Attorney, Agent, or Firm* — Dennis G. LaPointe

(57) ABSTRACT

An apparatus and method for blending a predetermined fluid with a main fluid wherein a source of a predetermined fluid is mixed with a main fluid. The predetermined fluid flows through an inlet of a positive displacement pump assembly and transferred to a mixing chamber through an outlet of the positive displacement pump assembly. A turbine blade assembly located within the mixing chamber is used to mix a main fluid flowing into the mixing chamber with the predetermined fluid for eventual dispensing through an outlet in the mixing chamber when desired.

14 Claims, 6 Drawing Sheets

FLUID BLENDING APPARATUS AND ASSOCIATED METHOD

FIELD OF THE INVENTION

The invention relates to the mixing or blending of two or more fluids at a desired ratio.

BACKGROUND OF THE INVENTION

Presently, fluid mixing in the contemplated fields where the invention would be useful is mainly accomplished by injecting a secondary fluid into a main fluid using an electrical pump. This means of mixing works as long as the flow remains constant and the pump speed is adjusted to supply the desired ratio of secondary fluid to main fluid. Pump mixing is not practical in many applications because electricity may not be available and/or the complexity of the design and components needed make it impractical.

Another method of mixing fluids is using siphon injectors. Siphon injectors work on the fluid dynamics principle of the venturi meter. This method has many limitations because the vacuum effect relies on atmospheric pressure to push siphon fluid into the venturi. Once the vacuum pressure approaches atmospheric pressure, the maximum siphon rate is reached regardless of additional pressure drop across the venture and no further fluid can be brought into the mixture.

What is needed is a mixer that makes it possible to provide accurate mixing of two or more fluids without using external power and to automatically adjust to changing flow rates maintaining precise ratio mixture during continuous changing flow rates.

SUMMARY OF THE INVENTION

The present invention is a fluid blending and mixing apparatus that passes a main fluid through turbine blades. A small amount of energy is used from the main fluid flow to turn the turbine shaft. As the turbine shaft rotates, it causes a pump gear, located in a separate chamber, to rotate. The rotation of the pump gear, in turn, causes a pump shaft to turn. The pump shaft is preferably shaped as a screw style positive displacement pump, although other types of pumps could be used. The rotation of this pump causes the mixing fluid to enter the pump at a "mixing fluid inlet" at low pressure and exit the pump at a "mixing fluid outlet" at high pressure. The inlet and outlet orifice or opening sizes are determined based on the application for the invention. As the mixing fluid enters the main fluid flow, it passes the turbine blades and, due to the turbulence of the fluid at this stage, it mixes with the main fluid.

As mentioned above, there are several types of positive displacement pumps that can be used for the present invention. A positive displacement pump causes a fluid to move by trapping a fixed amount of it and then forcing (displacing) that trapped volume into the discharge pipe. A positive displacement pump can be further classified as either: a rotary-type (for example the rotary or vane), a lobe pump similar to oil pumps used in car engines, the Wendelkolben pump or the helical twisted Roots pump, the liquid ring vacuum pump, or an Archimedes screw pump. These are examples only.

As the main fluid changes velocity, so does the turbine rotation, thus, the pump speed will adjust automatically causing the mixing fluid pumped into the main fluid to maintain constant mixing ratio.

The mixing ratio can be controlled by the gear ratio of turbine to pump, or by the design of the pump shaft.

The mixing can be stopped by disengaging the turbine/pump gears, or by blocking the mixing fluid inlet. One can also rotate the mixing fluid inlet so that the inlet becomes part of the main fluid and thus main fluid flows through the pump instead of the mixing fluid.

Typical components that comprise the invention are:

- a source of one or more predetermined mixing fluids which are dispensable into to a mixing chamber reservoir or independently dispensed directly from the fluid container: the chamber where the mixing fluid is kept;
- a mixing fluid inlet: this is where the mixing fluid(s) enters the pump;
- a pump cylinder: smooth polished cylinder where the positive displacement pump rotating shaft turns;
- a pump shaft: the main pump drive for the mixing fluid;
- a mixing fluid outlet: this is where the mixing fluid exits the pump and enters the main fluid stream;
- a check valve: a check valve can be placed at the mixing fluid outlet to prevent backflow during maintenance such as replacement of the pump shaft;
- an air vent check or bleed valve;
- a mixing chamber: this is the cylinder where the main fluid flows through and initial mixing with the mixing fluid take place;
- a turbine blade: blades that are located on a turning wheel positioned in such an angle as to provide maximum torque with minimum pressure drop;
- a turbine wheel: the wheel which houses the turbine blades;
- a turbine guide: guides may be put in place to help position the turbine wheel and ensure that all fluids are flowing through the blades;
- a turbine shaft: transfers the energy of the rotating wheel to the gears;
- a turbine gear: used to transfer rotational energy from the turbine to the pump;
- a pump gear: used to transfer the rotating energy from the turbine gear to the pump shaft; and
- means for driving the turbine and pump assemblies.

The present invention mixer can vary in size from very small to large. The size is determined by volumetric flow of the main fluid, mixing ratio, and operating pressures.

The invention can be used in many different applications and mix many different fluids. Some applications include mixing soap into water for:

1. Hand wash sinks and showers—soap bars or dispensing bottles will not be needed anymore; this can mean large savings for hotels.
2. Washing machines (cloths & dishes)—soap used will be precise and less mess.
3. Pet wash—This will make washing your dog, cat, or horse much easier.
4. General wash spray—Connecter to a garden hose or the inlet of a pressure washer, one will find washing much simpler.
5. Industrial tank wash—A process known as CIP can use the inventive mixer for proper chemical mixing used in the CIP process.

The invention can also be utilized with other such as chlorine and water, for example, automatic chlorine additive for pool maintenance, and gasoline additives, for example, at the pump, additives can be provided for better engine care.

DETAILED DESCRIPTION OF THE INVENTION

Figure 1A:
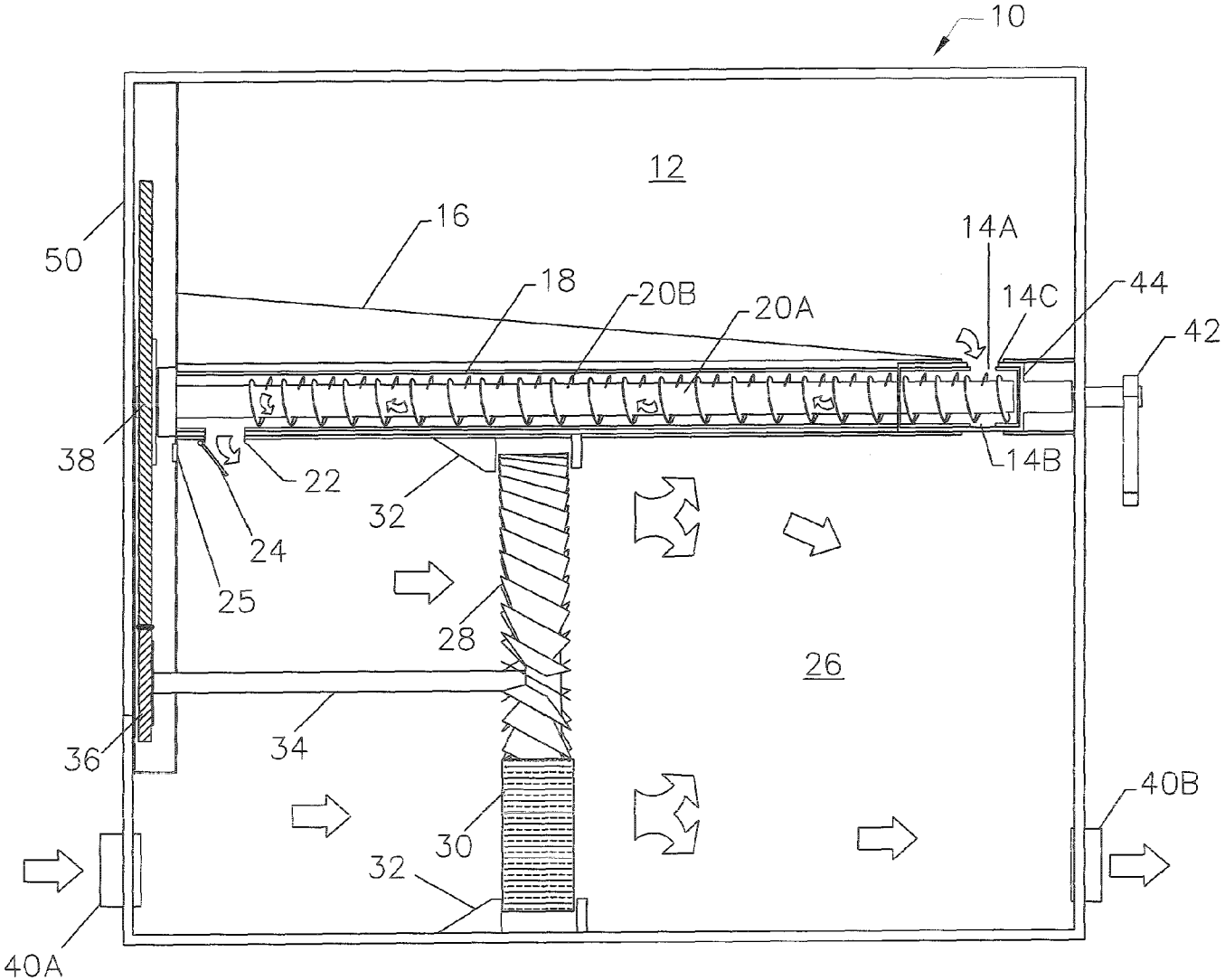
FIG. 1A is a schematic conceptual depiction one embodiment of the invention.
Figure 1B:
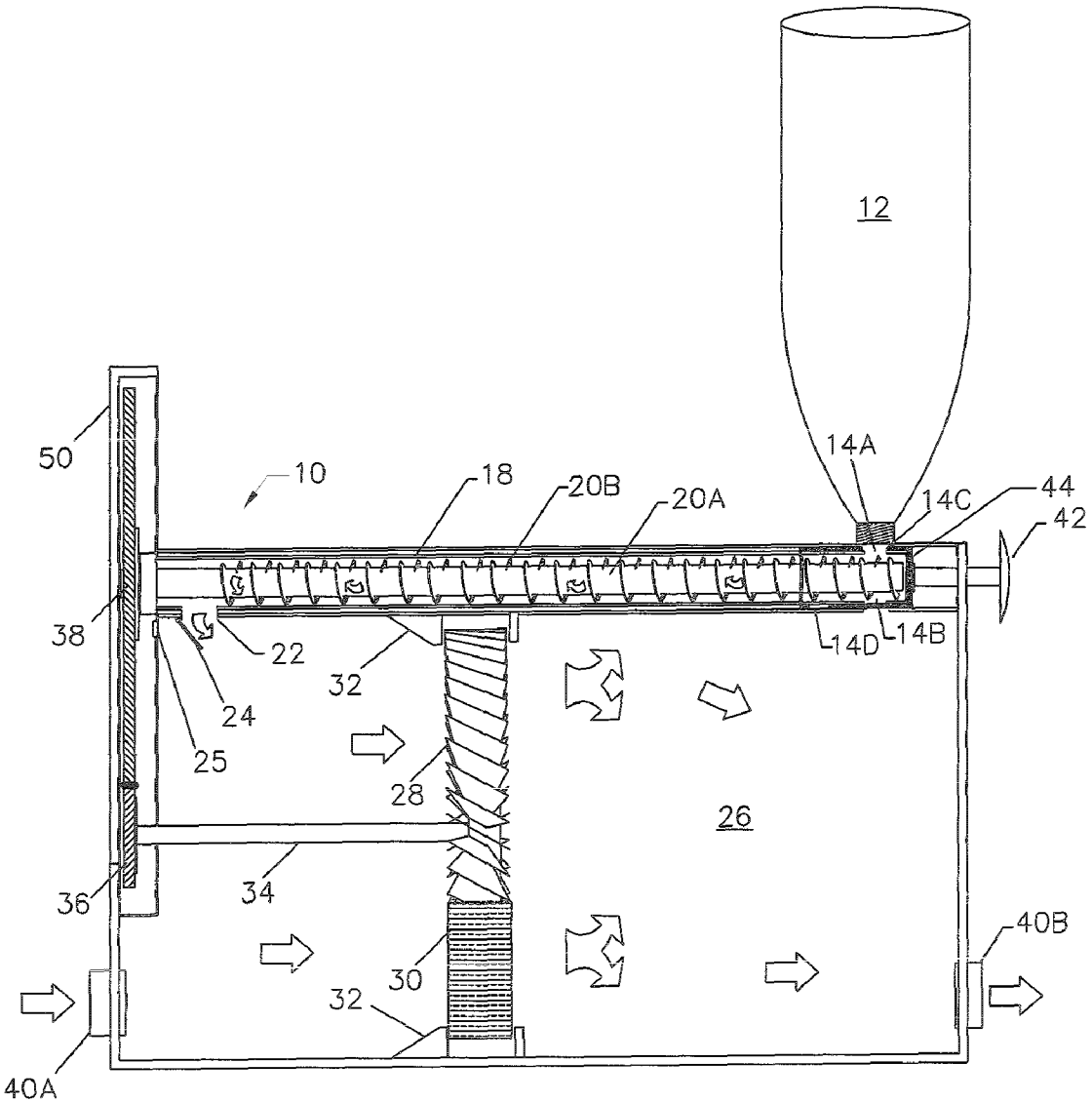
FIG. 1B is a schematic conceptual depiction of another embodiment of the invention.

Referring now to the drawing, FIGS. 1A and 1B disclose conceptually the present invention, which is an apparatus for blending a predetermined fluid with a main fluid, and is depicted generally as 10.

The fluid blending apparatus 10 comprises a source of a predetermined fluid which is dispensable either into a fluid chamber reservoir 12 or from its own container/reservoir as depicted in FIG. 1B. If a separate reservoir is utilized, the reservoir chamber 12 has a reservoir bottom 16 on which the predetermined fluid is dispensed. Reservoir bottom 16 may or may not be inclined as desired to facilitate gravity flow to the pump assembly discussed below.

The predetermined fluid flows through a fluid inlet 14A into a pump assembly comprising a pump cylinder 18 through which a pump rotating shaft 20A rotates. The pump rotating shaft 20A further has threads 20B and is configured to form a positive displacement screw pump where the screw pump forms a main pump drive for the predetermined fluid.

The predetermined fluid exits through a predetermined fluid outlet 22 in the pump assembly and enters a main fluid stream in a mixing chamber 26 in which the main fluid flows through from a mixing chamber inlet 40A and initial mixing with the predetermined fluid takes place.

The mixing or blending is further affected by a turbine blade assembly wherein blades 28 of the turbine blade assembly are located on a turning wheel 30 positioned in such an angle as to provide a maximum torque with a minimum pressure drop.

A turbine shaft 34 is in mechanical communication with a turbine gear 36 and is configured so as to transfer energy of the rotating turbine blade assembly to the turbine gear 36. The turbine gear/pulley 36 is in mechanical communication with a pump gear/pulley 38 and is configured so as to transfer a rotational energy to the pump gear/pulley 38 of the pump assembly. The pump gear/pulley 38 is in mechanical communication with the pump assembly shaft 20A.

There are several means known in the art to provide for the above described mechanical communication between the driven components of the turbine and pump, including pulley/gear combinations, toothed gears, magnetic couplers, direct drive, etc., all of which are a matter of design choice for providing the pump drive system or mechanism and the turbine drive system or mechanism.

A blended or mixed main fluid and predetermined fluid flows on demand from a mixing chamber outlet 40B.

As mentioned above, the fluid chamber reservoir may be an attached bottle as shown on FIG. 1B, or it may be a built-in reservoir 12 with a bottom 16 as conceptually depicted in FIG. 1A. The bottom 16 may be inclined for facilitating a flow of the predetermined fluid into the pump inlet 14A; and a check valve 24 located at the predetermined fluid outlet 22 to prevent backflow during maintenance may also be included. The mixing chamber 26 preferably includes means for preventing an air pocket from developing in the chamber 26 such as an air check valve 25 or other type of bleed valve.

The invention 10 further comprises one or more turbine guides 32 to facilitate a positioning of the turbine blade assembly and ensure that all of the main fluid and the predetermined fluid in the mixing chamber 26 are flowing through the blades 28.

Using the above apparatus 10, a method of blending a predetermined fluid with a main fluid accordingly comprises providing a source of a predetermined fluid to be mixed with a main fluid; dispensing the predetermined fluid through an inlet 14A of a positive displacement pump assembly (cylinder 18, shaft 20A, threads 20B, outlet 22, pump gear 38); transferring the predetermined fluid from a predetermined fluid reservoir 12 to a mixing chamber 26 through the outlet 22 of the positive displacement pump assembly; and using a turbine blade assembly (blades 28, wheel 30, guides 32, turbine shaft 34, turbine gear 36) within the mixing chamber 26, mixing a main fluid flowing into the mixing chamber 26 with the predetermined fluid.

The various chambers discussed above along with the associated components may generally be housed within an enclosure or housing 50 through which the main flow is connected at 40A and the mixed fluid exits at 40B.

Figure 3C:
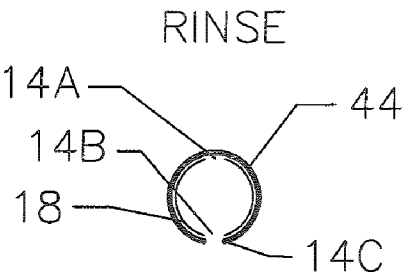
FIGS. 3A, 3B, 3C are respective depictions of the relative positioning of the mixing fluid inlet based on the corresponding position of the handles depicted in FIGS. 2A, 2B, 2C.
Figure 3B:
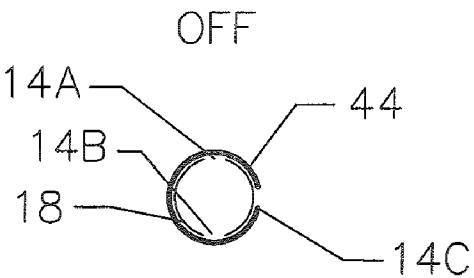
Figure 3A:
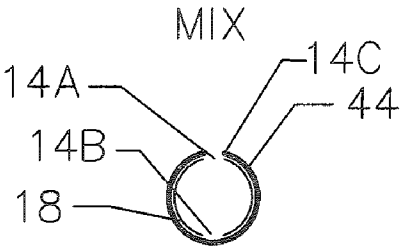
Figure 2C:
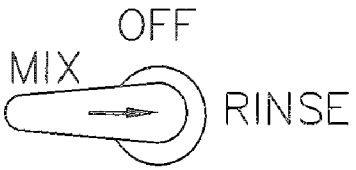
FIGS. 2A, 2B, 2C are respective end views of a representative example of one way of controlling the flow of mixing fluid using a handle in mechanical communication with the pump cylinder sleeve.
Figure 2B:
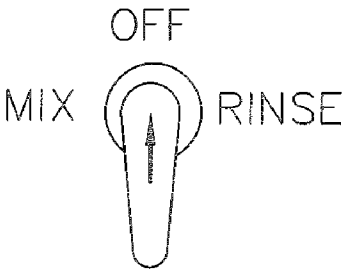
Figure 2A:
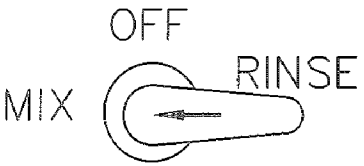
Figure 4A:
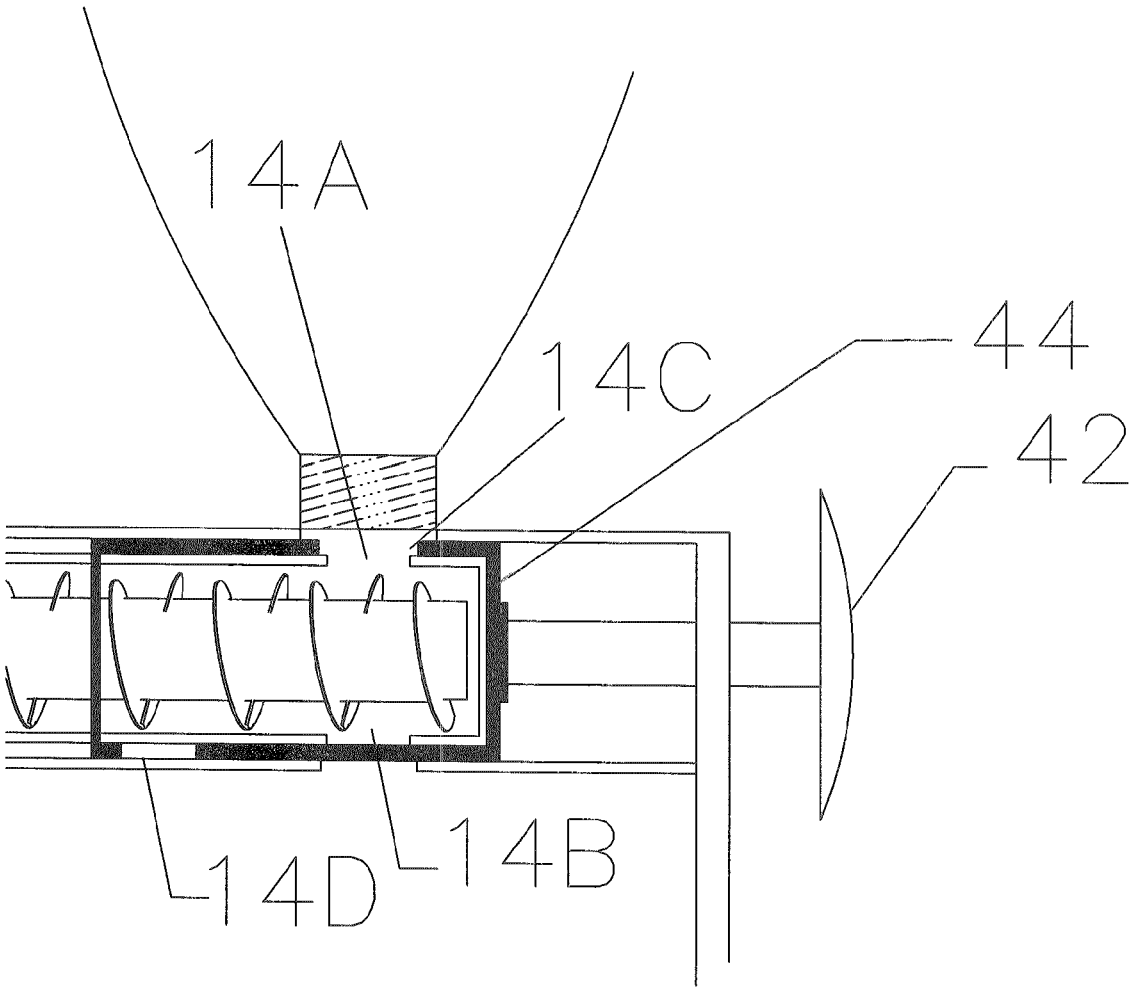
FIGS. 4A, 4B and 4C are conceptual cross-section depictions using a push/pull knob sliding sleeve arrangement as another example of a method of controlling the flow of mixing fluid.
Figure 4B:
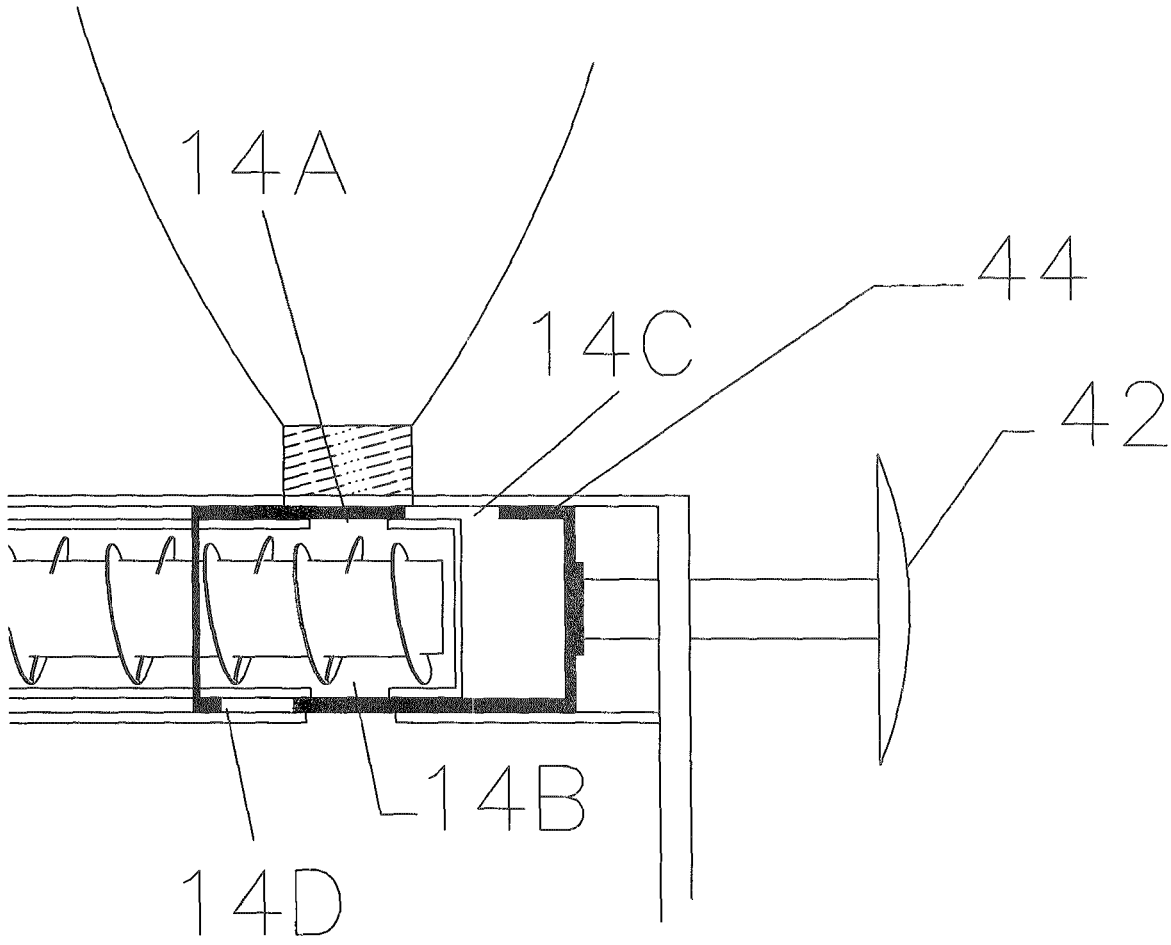
Figure 4C:
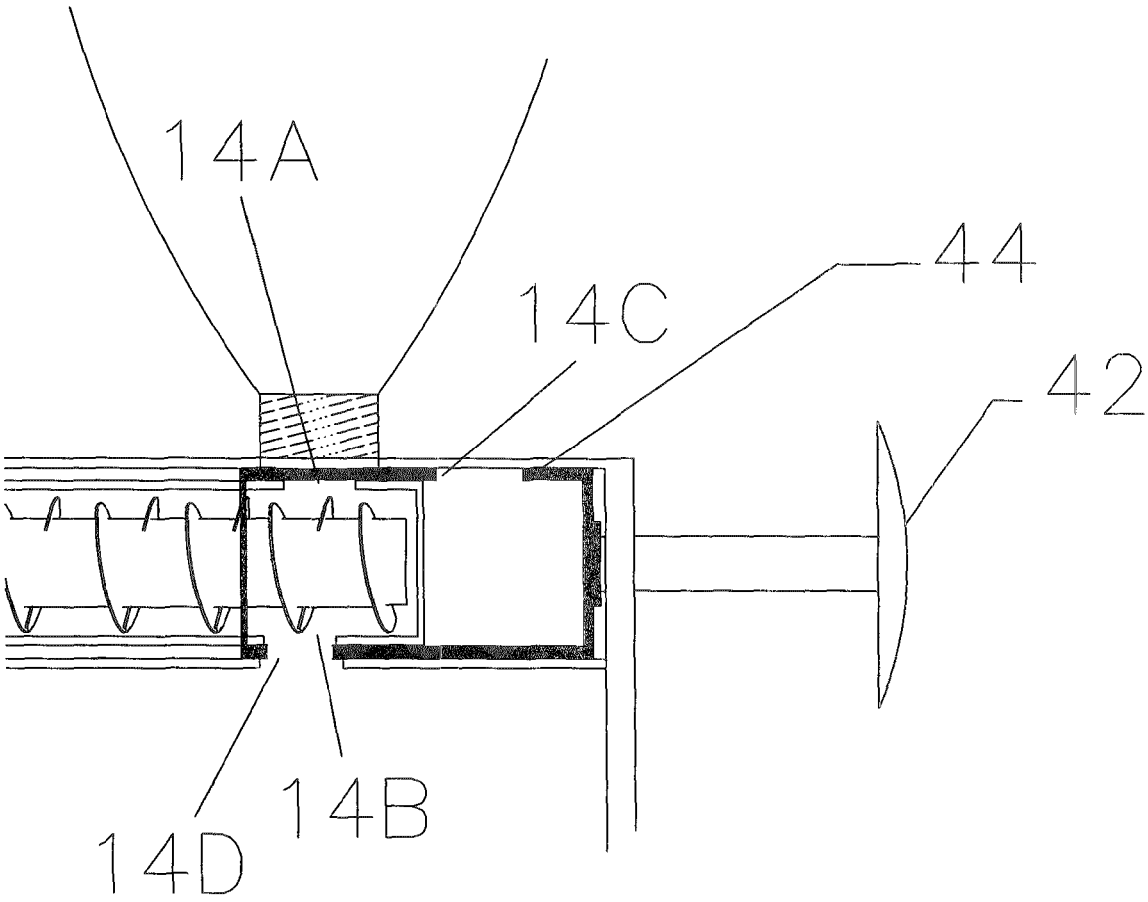

The invention 10 further includes means for stopping the mixing or blocking the mixing fluid from entering or exiting the pump assembly. One example of doing this to provide a mechanism for disengaging the turbine/pump gear assemblies. A preferred relatively simple method of controlling the mixing function of the invention is as conceptually depicted in corresponding FIGS. 2A and 3A, 2B and 3B, and 2C and 3C using a rotating handle assembly as depicted in FIG. 1A, where a handle or rotatable knob 42 is in mechanical communication with the pump cylinder sleeve 44. The mixing can be stopped by rotating the sleeve 44 such that sleeve opening 14C is positioned between pump cylinder opening 14A & 14B as shown in FIGS. 2B and 3B. The "OFF" position effectively totally isolates the pump assembly and mixing fluid so only main stream fluid is assured of flowing into inlet 40A and exiting through 40B. The mixing can also be stopped by rotating the sleeve 44 such that sleeve opening 14C is positioned at pump cylinder opening 14B as shown in FIGS. 2C and 3C. This position (or "RINSE" position) can be used for rinsing using the main stream fluid only to clean and maintain flow through the pump assembly. Another method involves a push/pull knob 42 as shown in FIG. 1B with FIGS. 4A, 4B and 4C. For a push/ pull knob assembly, one can put the system in "MIX" mode by pushing the knob fully inwards as in FIG. 4A. This position will align the top opening of the sleeve 14C with the pump cylinder opening 14A. To completely stop the flow, the knob 42 is placed midway as in FIG. 4B blocking the opening 14A and 14B. To put the system in rinse mode, the knob 42 is pulled to the maximum position as in FIG. 4C thus allowing the sleeve opening 14D to align with the cylinder opening 14B.

The flow of the main stream fluid is controlled by a separate means, for example, a valve in the main stream flow path (not shown), or other well know devices known in the art typical of the application in which the invention is being used.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A fluid blending apparatus comprising:

a source of a predetermined fluid which is dispensable into a fluid inlet through which said predetermined fluid flows into a pump assembly;

said pump assembly comprising a pump rotating shaft, which is configured as a positive displacement pump, said pump forming a main pump drive for said predetermined fluid;

a fluid outlet through which said predetermined fluid exits said pump assembly and enters a main fluid stream;

a mixing chamber in which a main fluid flows through from a mixing chamber inlet and initial mixing with said predetermined fluid takes place;

a turbine blade assembly wherein blades of said turbine blade assembly are located on a turning wheel positioned in such an angle as to provide a maximum torque with a minimum pressure drop;

a turbine shaft in mechanical communication with a turbine drive system and configured so as to transfer an energy of the rotating turbine blade assembly to said turbine drive system, said turbine drive system being in mechanical communication with a pump drive system and configured so as to transfer a rotational energy to said pump drive system of said pump assembly, said pump drive system being in mechanical communication with said pump assembly shaft; and a mixing chamber outlet through which a mixed main fluid and predetermined fluid flows on demand.

2. The apparatus according to claim 1, further comprising a fluid chamber reservoir into which said source of said predetermined fluid is dispensable, said fluid chamber reservoir being in fluid communication with said fluid inlet through which said predetermined fluid flows into said pump assembly.

3. The apparatus according to claim 1, further comprising a check valve located at said predetermined fluid outlet to prevent backflow during maintenance.

4. The apparatus according to claim 1, further comprising means for preventing air pockets from developing in said mixing chamber.

5. The apparatus according to claim 1, further comprising one or more turbine guides to facilitate a positioning of said turbine blade assembly and ensure that said main fluid and said predetermined fluid in said mixing chamber are flowing through said blades.

6. The apparatus according to claim 1, further comprising means for stopping a said predetermined fluid or for blocking said predetermined fluid from entering said pump assembly.

7. A method of blending a predetermined fluid with a main fluid comprising:

providing a source of a predetermined fluid to be mixed with a main fluid;

dispensing said predetermined fluid through an inlet of a positive displacement pump assembly;

transferring said predetermined fluid from a predetermined fluid container to a mixing chamber through an outlet of said positive displacement pump assembly; and using a turbine blade assembly within said mixing chamber, mixing a main fluid flowing into said mixing chamber with said predetermined fluid, wherein blades of said turbine blade assembly are located on a turning wheel positioned in such an angle as to provide a maximum torque with a minimum pressure drop.

8. The method according to claim 7, further comprising:

dispensing said mixed combination of said main fluid and said predetermined fluid through an outlet of said mixing chamber when desired.

9. The method according to claim 7, wherein said positive displacement pump assembly having a rotating shaft, and said pump assembly being configured to form a positive displacement pump, said positive displacement pump being a main pump drive for said predetermined fluid.

10. The method according to claim 7, wherein said turbine blade assembly further comprises:

a turbine shaft in mechanical communication with a turbine drive system and configured so as to transfer an energy of the rotating turbine blade assembly to said turbine drive system, said turbine drive system being in mechanical communication with a pump drive system and configured so as to transfer a rotational energy to said pump drive system of said pump assembly, said pump drive system being in mechanical communication with said pump assembly shaft.

11. The method according to claim 7, further comprising:

providing a check valve which is located at said predetermined fluid outlet to prevent backflow during maintenance.

12. The method according to claim 7, wherein said turbine blade assembly further comprises one or more turbine guides to facilitate a positioning of said turbine blade assembly and ensure that said main fluid and said predetermined fluid in said mixing chamber are flowing through said blades.

13. The method according to claim 7, further comprising means for stopping a said predetermined fluid or for blocking said predetermined fluid from entering said pump assembly.

14. The method according to claim 7, further comprising:

providing means for preventing air pockets from developing in said mixing chamber.

* * * * *